United States Patent [19]

Philippi

[11] Patent Number: 4,807,896

[45] Date of Patent: Feb. 28, 1989

[54] OPERATOR POWERED SKATEBOARD

[76] Inventor: Randy J. Philippi, 820 Scott Blvd., Santa Clara, Calif. 95051

[21] Appl. No.: 888,463

[22] Filed: Jul. 18, 1986

[51] Int. Cl.[4] ..... B62M 1/04

[52] U.S. Cl. ..... 280/243; 74/141; 192/41 A; 280/251; 280/87.042; D21/227

[58] Field of Search ..... 74/137, 141; 192/41 A; D21/227; 280/214, 215, 223, 225, 241, 243, 251, 252, 87.04 A

[56] References Cited

U.S. PATENT DOCUMENTS

| | | | |
|---|---|---|---|
| 1,409,103 | 3/1922 | Hawthorne, Sr. | 280/243 |
| 1,653,889 | 12/1927 | Clark | 280/251 X |
| 3,884,501 | 5/1975 | Elias et al. | 280/243 X |
| 4,082,267 | 4/1978 | Flavell | 74/141 X |
| 4,094,372 | 6/1978 | Notter . | |
| 4,289,325 | 9/1981 | Whitacre | 280/87.04 A |
| 4,319,760 | 3/1982 | Romano | 280/87.04 A X |
| 4,411,442 | 10/1983 | Rills | 280/87.04 A X |
| 4,515,362 | 5/1985 | Lin | 280/243 X |
| 4,595,209 | 6/1986 | Tsai | 280/87.04 A X |
| 4,606,548 | 8/1986 | Little | 280/12 H |

FOREIGN PATENT DOCUMENTS

| | | | |
|---|---|---|---|
| 92513 | 10/1968 | France | 280/251 |
| 571505 | 1/1958 | Italy | 280/251 |

*Primary Examiner*—David M. Mitchell
*Assistant Examiner*—Michael Mar
*Attorney, Agent, or Firm*—Douglas A. Chaikin

[57] ABSTRACT

An operator powered skateboard including a platform, a drive assembly mounted to the platform about a pivot axis for axial displacement. The drive assembly including an external power assembly engaging a skateboard axle for causing rotation of the axle in one direction and a handle connected to the external power assembly for selectively engaging the power assembly. The skateboard including at least two pairs of wheels, one pair connected to the drive assembly, the other pair mounted to the platform about a second pivot axis for independent axial displacement.

18 Claims, 5 Drawing Sheets

OPERATOR POWERED SKATEBOARD

FIELD OF THE INVENTION

This invention relates to human powered vehicles and more particularly to skateboards having operator powered external power means which are selectively engagable by the operator.

BACKGROUND OF THE INVENTION

Skateboards are small vehicles having pairs of front and rear wheels attached to a platform. The front and rear wheel pairs are made of a set of two small wheels, approximately 2½ inches in diameter. The wheels are made of various plastic or rubber composites. The wheels are connected to each other by an axle and supported by bearings on the axle. The axle is rigidly mounted to a pivot and a swing arm structure which provides axial displacement of the axles in response to a leaning motion by a person riding the skateboard. This axial displacement of both the front and rear wheels and axle provides the steering mechanism for the skateboard.

A person rides the skateboard by standing on the platform and pushing his foot against the riding surface to built up speed. Of course, forward motion may also be imparted by gravity, i.e. riding downhill. The speed obtainable by the rider on a flat riding surface is directly limited by the strength of his leg muscles. Of course, the efficiency of the foot contact with the riding surface is also important. However, the overriding factor in obtaining speed is the strength of the rider. Eventually, the skateboard will reach a speed where even the strongest rider can no longer exert a leg force against the riding surface which will cause further acceleration. The rider must then wait until his speed drops before a further exertion cycle can begin which will increase his speed.

While conventional skateboards have served and continue to serve valuable exercise, amusement and transportation needs, it has been left to this inventor to provide a economically practical skateboard which is not subject to the past restrictions of speed and physical human contact with the riding surface to cause acceleration.

SUMMARY OF THE INVENTION

It is thus an object of this invention to provide a skateboard which is assisted by an operator powered external power means.

It is a further object of this invention to provide a skateboard which has an operator powered external power means and which is compatible with conventional skateboards.

It is a further object of this invention to provide a skateboard which is assisted by an operator powered external power means which is independent of the angular displacement of the skateboard and axial displacement of the wheels.

It is a further object of this invention to provide a skateboard which is capable of having the external operator power applied to either pair of wheels.

It is a further object of this invention to provide a skateboard in which the external power is supplied to the skateboard by the use of the hand, arm and torso of the rider.

In accordance with the above objects, the skateboard of this invention comprises:

a platform;

a drive assembly mounted to the platform about a pivot axis for axial displacement, the drive assembly including:

a housing having a bore extending therethrough;

an axle through both ends of the housing bore;

operator powered external power means engaging the axle for causing rotation of the axle in one direction; and means connected to the external power means for selectively engaging the external power means; and at least two pairs of wheels, one pair connected to the drive assembly, the other pair of wheels mounted to the platform about a second pivot axis for independent axial displacement;

whereby, activating the selective engaging means causes the external power means to exert an additional rotational force to the wheels.

In a preferred embodiment the external power means comprises at least one threaded spool keyed to the axle and a cable fastened to the spool and the selective engaging means. The cable connects the external power means and the selective engaging means such that when the selective engaging means is activated the spool causes an additional rotational force to be exerted on the axle.

In the preferred embodiment, the wheels include clutch assemblies for transferring the rotational force created by the external power means to the wheels in one direction only. In an additional preferred embodiment, the clutch assemblies are centrifugally activated. The centrifugal clutches cause rotation from the external power means in one direction only and allow free-spinning or overrunning in either rotational direction.

The invention also includes a novel skateboard design wherein the ends of the skateboard are upwardly turned and curved to provide easy access to the ends by the rider as he rides the skateboard. In this embodiment, the skateboard may include drive assemblies, as described above which include the centrifugal clutch assemblies, on either pairs of the wheels. The skateboard of this embodiment is capable of externally powered operation in either the forward or rearward direction.

In the preferred embodiments, the skateboard includes a means for rewinding the cable back unto the spools so that the rider is ready for the next external power force cycle upon such rewinding without interfering with the normal operation of the skateboard.

The skateboard in accordance with this invention has the advantage of being externally powered by the rider without interfering with the normal operation of the skateboard.

The skateboard in accordance with this invention has the additional advantage of involving muscle groups other than leg muscles to cause acceleration.

The skateboard in accordance with this invention has the additional advantage of being externally powered by the rider in either direction.

These and other objects and advantages of this invention will be clearer with reference to the description of the drawings below.

DETAILED DESCRIPTION OF THE INVENTION

Figure 1:
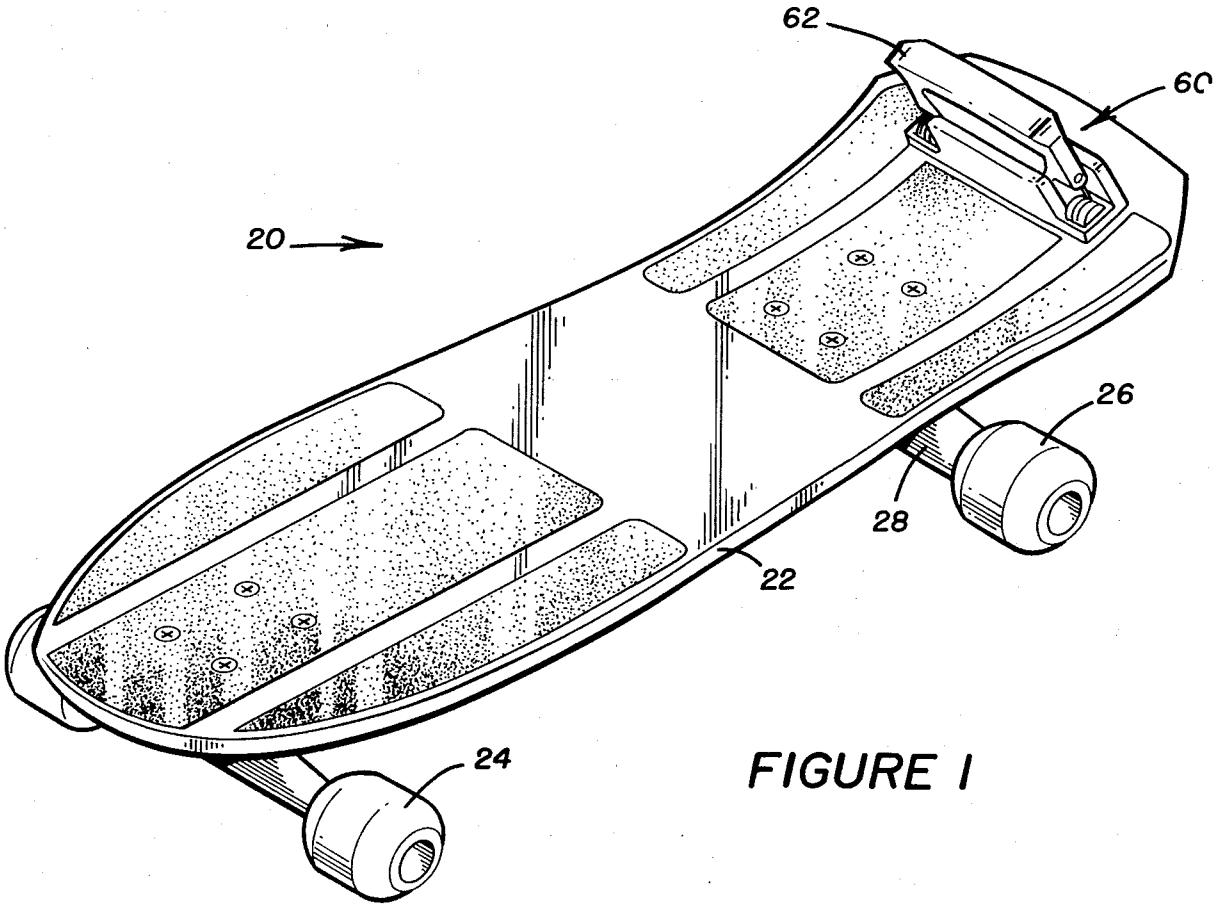
FIG. 1 is a perspective view of a skateboard in accordance with this invention.

The invention will now be described with reference to the drawings, wherein like reference characters designate like or corresponding parts throughout the several views and referring particularly to FIG. 1, there is shown a first preferred embodiment of the invention, a skateboard having a manually operated external power means, generally indicated by the numeral 20. The skateboard 20 includes a platform 22. Pairs of front and rear wheels, 24 and 26 respectively, are connected to the platform 22.

Figure 2:
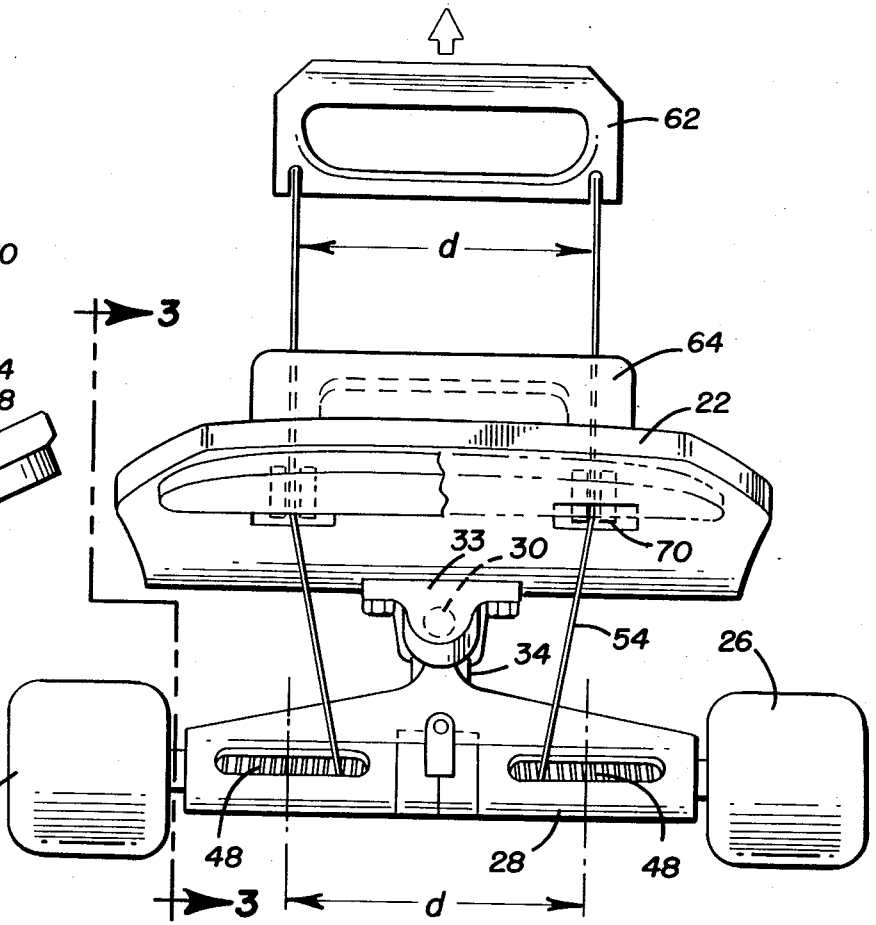
FIG. 2 is a rear elevational plan view of the skateboard shown in FIG. 1.

FIG. 2 illustrates the rear wheels 26 being mounted to a drive assembly 28. The drive assembly 28 is mounted to the platform 22 by a pivot 30 and a swing arm 32. The pivot 30 and the swing arm 32 facilitate the steering of the skateboard 20. The pivot 30 is connected to a the top mounting bracket 33 and the swing arm 32 is suspended by compressed bushings 34 around a top mounting bracket bolt 35 (FIG. 3) by a nut 36 and a washer (not shown). This steering arrangement allows the drive assembly 28 to have axial displacement equivalent to prior fixed axle systems. Axial displacement is independent of the operation of the external power means as will be appreciated more fully hereinafter.

The steering of skateboards is caused by the operator causing a weight shift against the board, which in turn causes an angular displacement of the platform 22. The angular displacement of platform 22 causes axial displacement of the wheels 26 which alters the direction of movement. The pivot 30 and swing arm 32 transfers the angular displacement of the platform 22 to axial displacement of the drive assembly 28.

As shown with respect to FIGS. 2-9, the drive assembly includes a housing 38 having an axial bore 40. An axle 42 is supported within the housing 38 by four bearings 44. Each bearing fits within the housing bore 40 and is held in place by an internal ring retainer 46. The diameter of the internal bore 40 between bearing locations is smaller than the bearing bores providing an internal abutment for the bearings.

Figure 7:
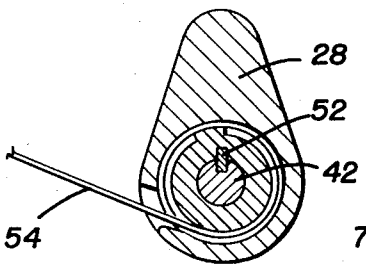
FIG. 7 is a cross-sectional view of the axle of the skateboard in accordance with this invention taken along line 7—7 of FIG. 4 looking in the direction of the arrows illustrating the connection of the spool and the axle and the winding of the cable to the spool.
Figure 6:
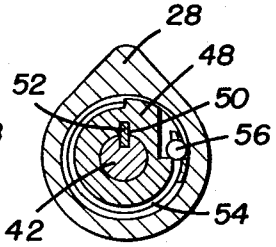
FIG. 6 is a cross-sectional view of the axle of the skateboard in accordance with this invention taken along line 6—6 of FIG. 4 looking in the direction of the arrows illustrating the connection of the spool and the axle and the fastening of the cable to the spool.
Figure 4:
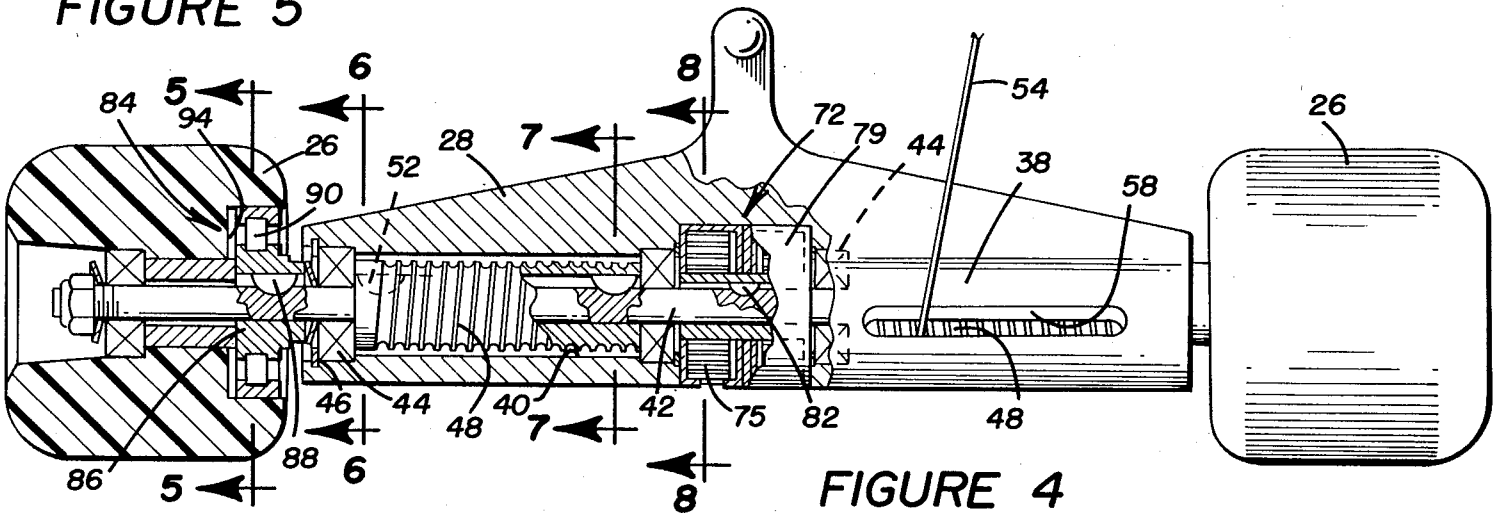
FIG. 4 is a rear plan view in partial section of the skateboard in accordance with this invention taken along line 4—4 of FIG. 3 looking in the direction of the arrows.

Two oppositely threaded spools 48 are located between the bearings 44 and more particularly between the above described bearing abutments. The spools 48 are spirally threaded and have an exterior diameter smaller than the housing bore 40 to provide clearance from frictional contact. The spools 48 are axially bored to the diameter of the axle 42 and have a full length keyway 50 enabling insertion of the spool 48 over the axle 42 and coupling with the axle 42 by woodruf keys 52 at each end of the spools 48 as best seen in FIGS. 4,6 & 7.

The thread of the spools 48 has a width and a depth slightly larger than the diameter of a cable to be used, such as cable 54. The bottom of the thread is radiused semicircularly. The top edges of the threads are rounded on both sides. This thread arrangement allows the cable 54 to be wound and unwound with minimal abrasion and the exterior of the cable 54 is contained within the thread of the spool 48.

The two cable spools 48 are identical, except one is left hand threaded and the other is right hand threaded. The threading extends substantially the length of the spool 48 with the thread terminating prior to the end of the spool 48 into a cross drilled hole where a ball end plug 56 is inserted (Figure 6). The ball end plug 56 is fastened to one end of the cable 54 by crimping, thus providing the fastening point for the end of the cable 54 to the end of the spool 48.

The drive housing 38 has angled slots 58 which define openings in the housing 38. The slots 58 are cut parallel to the length of the spools 48. The cable 54 exits the housing through the slots 58 facilitating the winding and unwinding of the cable 54 on the threads of the spools 48. The slots 58 are larger than the cable diameter 54. The slots 58 are tangential to the cable spools 48 and angled towards the pulleys 70 of a cradle assembly 64. The angle and width of the slots 58 are designed to minimize frictional contact of the cable 54 with the drive housing 38.

Figure 3:
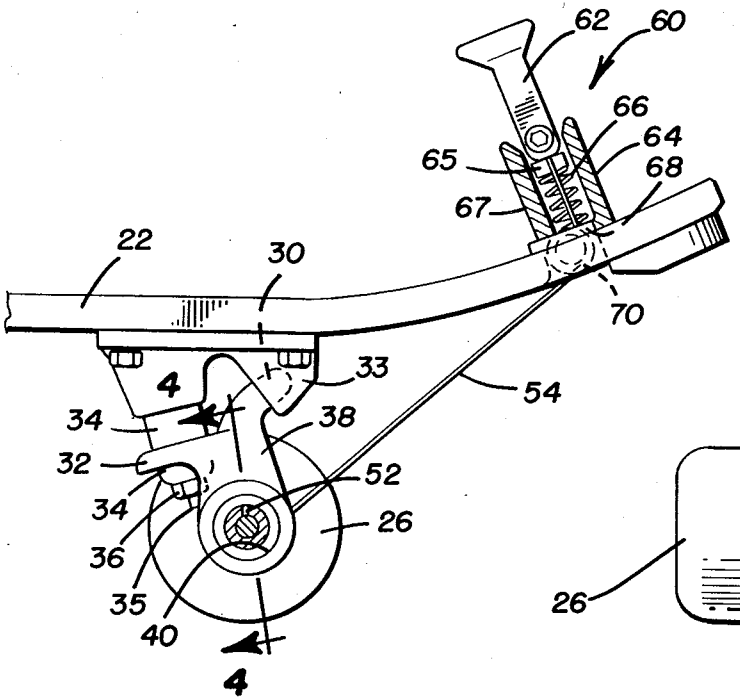
FIG. 3 is a side plan view of the skateboard in accordance with this invention taken along line 3—3 of FIG. 4 in the direction of the arrows.

As shown with particular reference to FIGS. 1-3, the other end of the cable 54 is connected to a pull assembly, generally indicated by the numeral 60. The pull assembly 60 includes a handle 62 having fastening means (not shown) for the cable 54 and a cradle assembly 64 having a plate 65 suspended by compression springs 66 for elevating the handle 62 to minimize movement and vibration of the handle 62. The compression springs 66 are attached to the plate 65 and cradle assembly 64 by spring retainers and countersunk flat head machine screws. The combination of the compression springs 66 and plate 65 also serves to keep tension on the cables between the cradle assembly 64 and the drive assembly 28.

The cradle assembly 64 has two bracket appendages (not shown) which recede through rectangular cut holes in the platform 22. The cradle 64 further has openings 68 through which the cable 54 is threaded for connection to the handle 62. The cradle assembly 65 includes cable pulleys 70 aligned with the openings 68 so that the cable 54 slides along the pulleys 70 as it is wound and unwound. The pulleys 70 are located such that they are centralized between the top surface and bottom surface of the platform 22 and are axially parallel to the axle 42, when the skateboard 22 is at rest.

The pulleys 70 each contain two ball bearings press fit into bores on both sides of the pulleys 70. The pulleys 70 are attached to the bracket appendages (not shown) by countersunk flat head machine screws, the same diameter as the ball bearings inner bore. Flat washers are placed between each side of the pulleys and the inside of the bracket appendages to provide clearance from frictional contact.

The pulleys 70 are centrally grooved around the circumference to a depth slightly larger than the diameter of cable 54. The edges of the groove are angled from the bottom of the groove out and rounded at the top to allow for the varying cable angles as the cable 54 is wound and unwound.

The distance d between the central grooves of the pulleys 70 is equal to the distance d between the longitudinal center points of the slots 58. The diameter d provides the minimum cable angle to the pulleys 70 during winding and unwinding of the spools 48.

The cable 54 extends downward from the handle 62 into the grooves of the pulleys 70 that are adjacent to the cradle assembly 64. This provides a funneled attack area for the cable 54, minimizing frictional contact or binding as the cable 54 is wound and unwound. When the handle 62 is resting in the cradle assembly 64 the cable 54 lines up directly over the funneled cable attack area.

The handle 62 is grasped by the skateboard rider, who pulls it to provide the additional rotational force to the wheels 26. It will be appreciated that the cable 54 can either be one length or two separate lengths. In the case where the cable 54 comprises two separate lengths, the cable is terminated by cable thimbles and crimped loop sleeves (not shown) and fastened to the handle 62 by counter sunk flat head machine screws within the handle 62.

Figure 8:
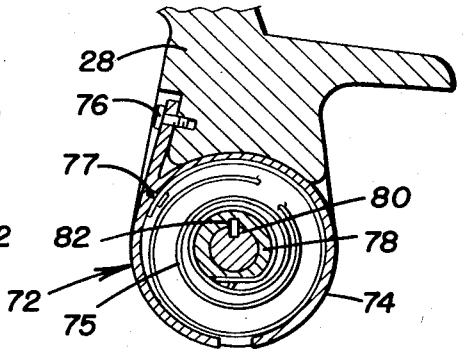
FIG. 8 is a cross-sectional view of the axle of the skateboard in accordance with this invention taken along line 8—8 of FIG. 4 looking in the direction of the arrows illustrating the connection of the constant force spring assembly with the drive assembly.
Figure 9:
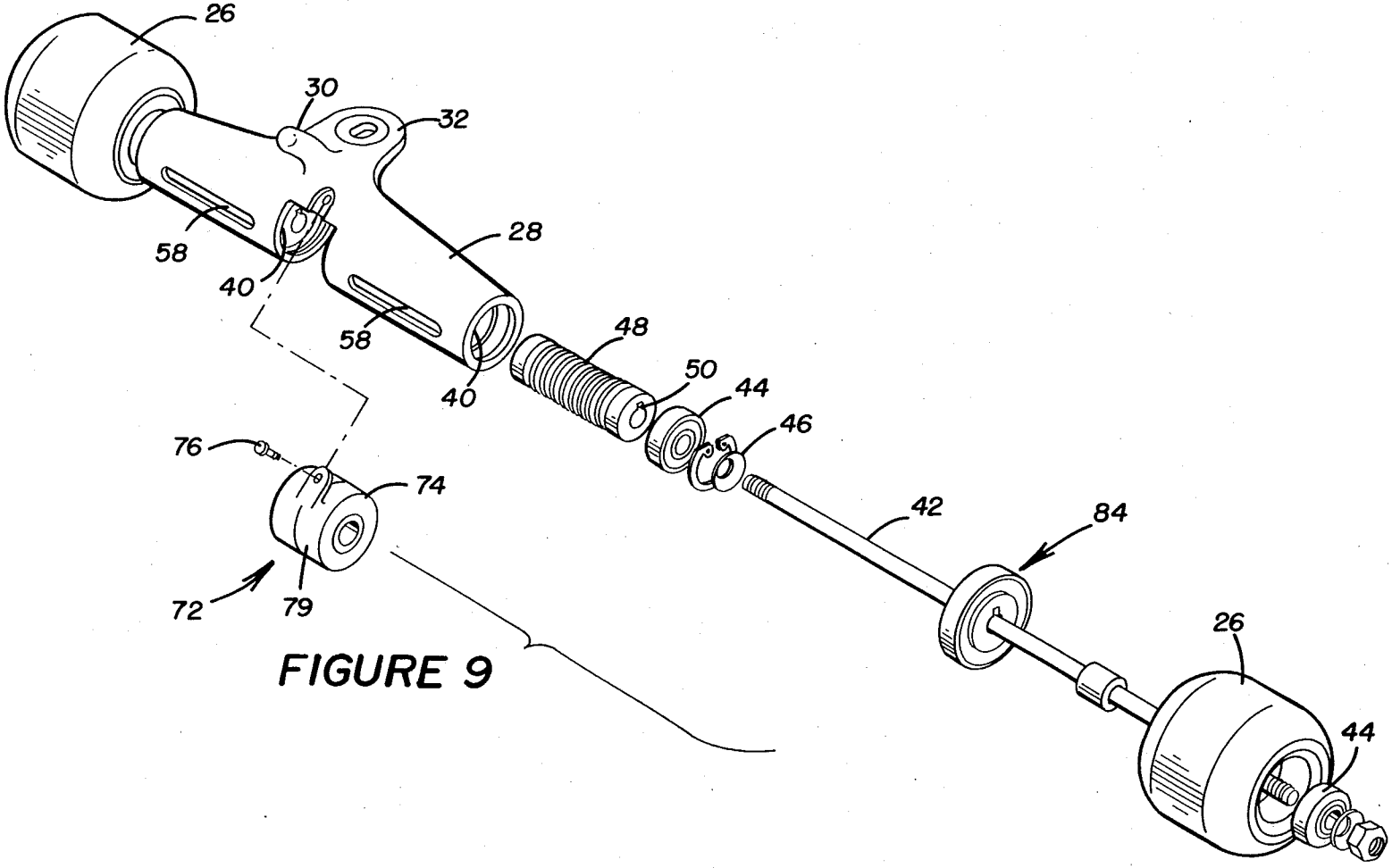
FIG. 9 is an exploded view of the drive assembly.

With particular reference to FIGS. 4, 8 & 9, there is shown the means for rewinding the cable 54 after it has been pulled to give added acceleration to the wheels 26, generally indicated by the numeral 72. The rewind means 72 includes a constant force spring assembly 74 having a spirally wound constant force spring 75 which is centrally located around the axle 42. The spring assembly 74 has spring assembly housing 79 secured to the drive assembly housing 38 by fastening means 76. The outside circumferential end of the spring 75 is attached to the inside of the spring assembly housing 79 by fastening member 77. The inside circumferential end of the spring 75 is connected to a housing 78. The bushing 78 is bored to the diameter of the axle 42 and has a full length keyway 80. The bushing 78 is coupled to the axle 42 by woodruf key 82.

The winding direction of the spring 75 around the axle 42 causes the spring 75 to be wound as the axle 42 rotates in the forward direction (the direction in which the added rotational force is applied). Energy is thus stored in the spring 75. The energy is sufficient to cause a counter rotational force to the axle 42 such that at the end of the pulling cycle (when the handle 62 is released), the cable 54 is wound back onto the spools 48. Thus after a pulling cycle is completed, a new additional rotational force may be applied to the wheels 26.

Figure 5:
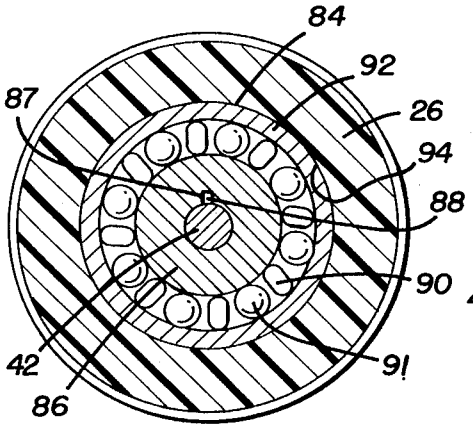
FIG. 5 is a cross-sectional view of the wheel assembly of the skateboard in accordance with this invention taken along line 5—5 of FIG. 4 looking in the direction of the arrows.

In order to provide rotational force to the wheels 26 from the axle 42 and to facilitate the rewinding of the cable 54 onto the spools 48, each of the wheels 26 include a clutch assembly 84. The clutch assembly 84 includes an inner race 86 having a keyway 87 and is keyed to axle 42 by a woodruf key 88, as best shown in FIGS. 4 & 5. The clutch assembly 84 further includes an outer race 92 frictionally fit within a bore 94 of the wheel 26. Between the inner race 86 and outer race 92 are cam members 90 and ball bearings 91. Cam members 90 and ball bearings 91 are alternately spaced.

The rotation of the axle 42 in the forward direction causes the cam clutch to engage, forcing the wheel 26 to rotate in the direction of the rotating axle 42. Rotation of the axle 42 in the opposite direction or no rotation at all allows the wheel to continue rotating (overrunning) in the desired direction. In an alternative embodiment of the invention, the skateboard includes a clutch having an outer race capable of overrunning in both rotational directions. This is accomplished by a centrifugally actuated cam replacing the ball cam clutch shown in FIGS. 4 & 5. Using this embodiment, only when the inner race is rotated in one direction would the clutch provide engagement and rotate the outer race. The wheels 26 of the skateboard in accordance with this embodiment would thus be able to move freely in either direction without cam clutch lock-up.

It will be recalled that the cradle assembly 64 through the plate 65 and the compression springs 66 elevates the handle 62 and creates a tensioning force on the cable 54 between the cradle and drive assemblies, 64 and 28 respectively. The constant force spring 75 also adds to this tensioning force and serves to create maximum recoiling force for rewinding. Also, the cradle assembly 64 acts as a shock absorber in any attempted backward motion of the wheels 26.

FORCE TORQUE AND ACCELERATION

The functioning of this invention is next described relative to the general physical laws in accordance with the forces, torques and acceleration potentials created by the invention.

It will be assumed that the skateboard 20 has a wheel diameter of 2.5 inches. Also it will be assumed that the weight of the rider and skateboard 20 combined is 161 pounds. These assumptions will be used to make calculations, and draw certain conclusions in the following formula:

$$T=F\times D,$$

where

T is torque, F is force and D is distance.

The torque generated on the axle 42 of the drive assembly 38 is equal to the tensional force in the cable 54 times the pitch radius of the spools 48.

Assume the use of a 2.5 inch diameter skateboard wheel, the usable cable spool diameters are confined between two limits, namely, the smallest diameter that can be mounted on an axle within a given diameter and the largest diameter allowing sufficient clearance between the drive housing 38 and the riding surface.

For the purposes of these calculations, the two limiting spool diameters will be used. First, it will be assumed that the axle 42 has a diameter of 5/16 inch and a spool diameter of approximately ½ inch with a cable pitch radius of 7/32 inch.

Assume a minimum clearance between the drive housing 38 and the riding surface of ½ inch, the largest spool diameter is approximately 1¼ inches with a cable pitch radius of 19/32 inch.

Assuming a practical cable tension pulling force of 100 pounds, by the skateboard rider yields the following results: (Calculations shown below assume a one cable, one spool embodiment of the invention. In the embodiment shown in the several Figures, there are two spools 48 and two separate lengths of cable 54. In order to apply the calculations below to the embodiment shown, it will be appreciated that the forces and torques on each spool are one half of the quantity shown).

| 7/32 Inch Cable Pitch Radius | 19/32 Inch Cable Pitch Radius |
|---|---|
| $T = F \times D$ | $T = F \times D$ |
| $T = 100$ lbs. $\times$ 7/32 inch | $T = 100$ lbs. $\times$ 19/32 inch |
| $T = 21.875$ in-lbs. | $T = 59.375$ in-lbs. |

The torque on the axle 42 is now applied to the wheels 26 through the clutch assemblies 84. The wheel radius is equal to 1.25 inches, therefore the force exerted by the wheel to the riding surface is: (calculations shown, combine both wheels into one, whereas in the invention, the forces and torques on each wheel are one half of the quantity shown.)

| 7/32 Inch Cable Pitch Radius | 19/32 Inch Cable Pitch Radius |
|---|---|
| $F = T/D$ | $F = T/D$ |
| $F = \frac{21.875 \text{ in-lbs.}}{1.25 \text{ in.}}$ | $F = \frac{59.375 \text{ in-lbs}}{1.25}$ |
| $F = 17.5$ lbs. | $F = 47.5$ lbs. |

With the weight of the skateboard and rider at 161 lbs. and the riding surface being level the following accelerations are obtained:

$$\text{Force} = \text{mass} \times \text{acceleration}$$

$$A = \frac{F}{M}$$

$$M = \frac{161 \text{ lbs.}}{32.2 \text{ ft/sec}^2} = 5 \text{ slugs}$$

| 7/32 Inch Cable Pitch Radius | 19/32 Inch Cable Pitch Radius |
|---|---|
| $A = F/M$ | $A = F/M$ |
| $A = \frac{17.5 \text{ lbs.}}{5 \text{ slugs}}$ | $A = \frac{47.5 \text{ lbs}}{5 \text{ slugs}}$ |
| $A = 3.5 \text{ ft/sec}^2$ | $A = 9.5 \text{ ft/sec}^2$ |

The duration of the acceleration of the skateboard and rider are directly related to the speed of the skateboard and rider and spool pitch diameter/thread length. The usable cable length the rider can pull out of the drive housing is limited by human geometries and the placement of the handle/cradle assembly.

Assuming a practical cable pull length of 40 inches, leads to approximately 29 cable turns on the 7/32 embodiment and approximately 11 turns on the 19/32 embodiment. The required pulling speed of the cable 54 increases with the speed of the skateboard 20 and decreases with decreasing diameter cable spools 48. The usable acceleration time per full cable length pull will be a function of these two variables.

From the above calculations it can be seen that the accelerations available by different spool diameters provide a versatile range for various skateboarding applications (i.e., general purpose riding, competition/racing applications on small skateboard courses and the like).

Other spool diameter configurations would also be possible, such as a tapered spool providing a varying torque/acceleration as the cable is pulled or a stepped cable spool, with a transition from one spool diameter to another midway along the spools threaded length. The various cable spool configurations could be interchangeable within a single drive housing by utilizing appropriate barrel inserts matched to the spool to be used.

Additionally, the use of skakeboard wheels of larger or smaller diameters than used in the calculations above, could produce other torque/acceleration limits than those described above.

Figure 10:
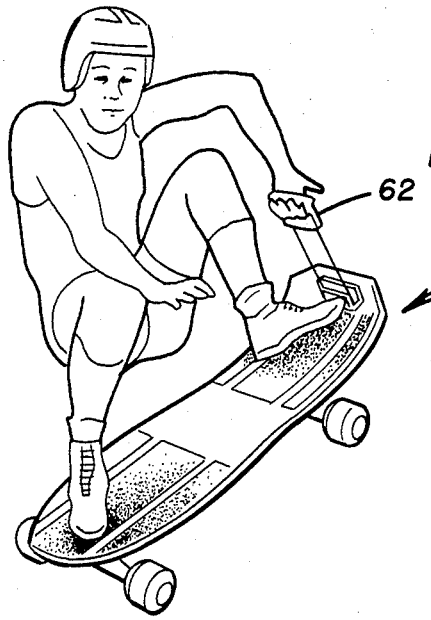
FIG. 10 illustrates the skateboard in accordance with this invention in use.

With particular reference to FIG. 10, there is shown the skateboard 20 in use. As the rider pulls the handle 62 upwards, in the direction of the arrow of FIG. 2, the cable 54 is unwound from the spools 48 causing an additional forward force to be exerted on the axle 42. The additional forward force causes the constant force spring 75 to be wound about the axle 42. When the handle 62 is released, the constant force spring 75 winds the cable 54 onto the spools 48. In this way the operator powered external power means is selectively engaged and prepared again to impart additional rotational force to the wheels 26.

As will be appreciated, the operation of the external power means does not interfere with the riding of the skateboard. The rider is free to balance and turn the skateboard 20 as with a conventional skateboard. The operation of the external power means does not interfere with the axial displacement necessary to turn the skateboard 20 as a result of the pivot 30 and swing arm 32 connection with the platform 22 described earlier.

Figure 11:
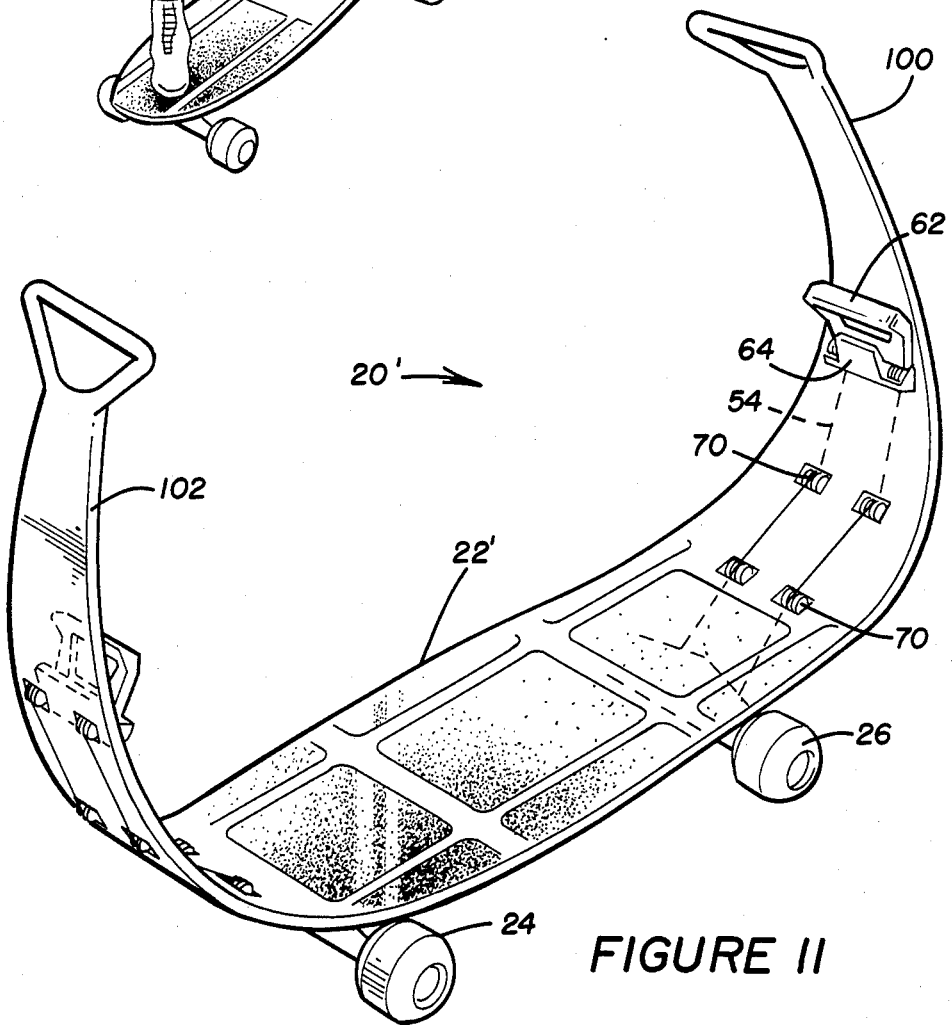
FIG. 11 illustrates an alternate embodiment of a skateboard in accordance with this invention.

Another embodiment of a skateboard in accordance with this invention is shown in FIG. 11, and generally denoted by the numeral 20'. The skateboard 20' includes external power means at both the front and rear wheels, 24 and 26 respectively. Thus, the front wheels 24 are connected to platform 22' in the same way as as earlier described with respect to the skateboard 20.

The skateboard 20' includes a modified platform 22' having extended front and rear ends 100 and 102, respectively. The extended ends allow the placement of the handle 62 and the cradle assembly 64 in a higher location relative to the foot placement area than the earlier described embodiment. An additional set of pulleys 70 is provided to allow smooth winding and unwinding of the cable 54. Both ends of the platform 22' are identical, including having identical drive assemblies 28.

The skateboard 20' employs the centrifugal clutches mentioned earlier with respect to skateboard 20 in order to enable the wheels 24 and 26 to be overrunning in both directions. The skateboard 20' can thus be steered from either end and in reality there is no front or rear end. The terms front and rear being used herein for purposes of description only. A rider can merely turn his body in the direction desired without care as to whether the end is the original front or rear.

While the instant invention has been described by reference to what is believed to be the most practical embodiments, it is understood that the invention may embody other specific forms not departing from the spirit of the central characteristics of the invention. Particularly, the clutches and bearings selected may be changed or updated with more modern technology to perform the same or equivalent function as those described herein within the spirit and scope of the present invention. Additional changes to the particular wheel and pitch diameters are also contemplated within the spirit and scope of this invention. The present embodiments therefore should be considered in all respects as illustrative and not restrictive, the scope of the invention being limited solely to the appended claims rather than the foregoing description and all equivalents embraced thereto being intended to be embraced therein.

What is claimed is:

1. An operator powered skateboard, comprising:
a platform;
a drive assembly mounted to the platform by a pivot and swing arm structure for movement about a first pivot axis, the drive assembly including:
a housing having a bore extending therethrough, the housing having a longitudinal axis perpendicular to the first pivot axis, the housing having a slot extending along a substantial portion of the longitudinal axis; and
an axle extending through both ends of the housing bore and being rotatably supported therein;
operator power means for causing rotation of the axle with approximately constant torque, the operator power means including a threaded spool within the housing and fastened to the axle, the spool having a longitudinal axis parallel to the longitudinal axis of the slot and a cable fastened at one end to the spool and the other end of the cable exiting the drive assembly housing and fastened to a handle means for selectively engaging the operator power means, the cable being tangentially fed to the spool through the slot and means for rewinding the spool comprising a spring means for storing rotational energy as the cable is unwound from the spool, the spring means fastened at one end to the axle and connected to the housing at the other end; and
at least two pairs of wheels, one pair connected to the axle of the drive assembly, the other pair of wheels mounted to the platform about a second pivot axis, the first and second pair of wheels pivoting in opposite directions about their respective axes upon tilting of the platform for independent axial displacement, the one pair connected to the drive assembly having clutch means for permitting rotational force by the operator power means to be applied in one direction only,
whereby, pulling the handle during axial displacement, such as when the platform is tilted, causes the operator power means to exert a constant torque rotational force to the wheels.

2. A skateboard as set forth in claim 1, wherein the operator power means includes:
a pair of oppositely threaded spools, each spool fastened to the axle; and
the handle means mounted on the platform approximately at the midpoint of the axle.

3. A skateboard as set forth in claim 2, wherein the handle means includes a cradle assembly mounted on the platform and the handle means resting on the cradle assembly when the cable is in the wound position with the cable fully threaded on the spools.

4. A skateboard as set forth in claim 3, wherein the cradle assembly includes compression springs for suspending the handle at an elevated level to minimize handle movement and vibration.

5. A skateboard as set forth in claim 1, wherein the spring means comprises a constant force spring.

6. A skateboard as set forth in claim 1, wherein the cable is made from an aramid fiber material.

7. A skateboard as set forth in claim 1, wherein the clutch means has a centrifically activated cam having an outer race capable of overrunning in both directions and an inner race capable of rotation without cam engagement in one direction only, whereby the wheels can rotate freely in either direction.

8. A skateboard as set forth in claim 1, wherein the handle means comprises a single handle.

9. A skateboard as set forth in claim 1, wherein the other pair of wheels is connected to an independent identical drive assembly and both pairs of wheels have clutch assemblies.

10. A skateboard as set forth in claim 1 wherein an edge of the slot is angled to define a sliding edge for the cable.

11. An operator powered skateboard, comprising:
a platform;
a drive assembly mounted to the platform by a pivot and swing arm structure for movement about a first pivot axis, the drive assembly including:
a housing having a bore extending therethrough, the housing having a longitudinal axis perpendicular to the first
pivot axis, the housing having a slot extending along a
substantial portion of the longitudinal axis; and
an axle extending through both ends of the housing bore and being rotatably supported therein;
operator power means for causing rotation of the axle including a threaded tapered spool within the housing and fastened to the axle, the spool having a longitudinal axis parallel to the longitudinal axis of the slot and a cable fastened at one end to the spool and the other end of the cable exiting the drive assembly housing and fastened to a handle means for selectively engaging the operator power means, the cable being tangentially fed to the spool through the slot and means for rewinding the spool comprising a spring means for storing rotational energy as the cable is unwound from the spool, the spring means fastened at one end to the axle and connected to the housing at the other end; and
at least two pairs of wheels, one pair connected to the axle of the drive assembly, the other pair of wheels mounted to the platform about a second pivot axis, the first and second pair of wheels pivoting in opposite directions about their respective axes upon tilting of the platform for independent axial displacement, the one pair connected to the drive assembly having clutch means for permittng rotational force by the operator power means to be applied in one direction only,
whereby, pulling the handle during axial displacement, such as when the platform is tilted, causes the operator power means to exert a rotational force to the wheels.

12. A skateboard as set forth in claim 11, wherein the spools are stepped.

13. A skateboard as set forth in claim 11, wherein the spool is spirally threaded and the threads of the spool are wider and deeper than the diameter of the cable, the bottom of the thread is radiused semi-circularly, and the top edges of the thread are rounded on both sides to minimize wear.

14. A skateboard as set forth in claim 11, wherein the cradle assembly includes a pully upon which the cable rides.

15. A skateboard as set forth in claim 14, wherein the pulley is centrally grooved at a depth larger than the diameter of the cable, and wherein the edges of the grooves of the pulley is angled from the bottom of the groove out and rounded at the top to accommodate varying pull angles.

16. A skateboard as set forth in claim 15, wherein the operator power means includes a pair of oppositely threaded spools, each spool fastened to the axle and wherein the distance between the central grooves of the pully equals the distance between the mid-points of the slots in the drive assembly housing for minimizing the cable angle during pull and rewind.

17. An operator powered skateboard, comprising:

a platform having extended ends, the ends being curved and rising above the platform;

a drive assembly mounted to the platform by a pivot and swing arm structure for movement about a first pivot axis, the drive assembly including:

a housing having a bore extending therethrough, the housing having a longitudinal axis perpendicular to the first pivot axis, the housing having a slot extending along a substantial portion of the longitudinal axis; and an axle extending through both ends of the housing bore and being rotatably supported therein;

operator power means for causing rotation of the axle including a threaded spool within the housing and fastened to the axle, the spool having a longitudinal axis parallel to the longitudinal axis of the slot and a cable fastened at one end to the spool and the other end of the cable exiting the drive assembly housing and fastened to a handle means for selectively engaging the operator power means, the cable being tangentially fed to the spool through the slot and means for rewinding the spool comprising a spring means for storing rotational energy as the cable is unwound from the spool, the spring means fastened at one end to the axle and connected to the housing at the other end; and at least two pairs of wheels, one pair connected to the axle of the drive assembly, the other pair of wheels mounted to the platform about a second pivot axis, the first and second pair of wheels pivoting in opposite directions about their respective axes upon tilting of the platform for independent axial displacement, the one pair connected to the drive assembly having clutch means for permitting rotational force by the operator power means to be applied in one direction only, whereby, pulling the handle during axial displacement, such as when the platform is tilted, causes the operator power means to exert a constant torque rotational force to the wheels.

18. A skateboard as set forth in claim 17, wherein the other pair of wheels is connected to an independent identical drive assembly and both pairs of wheels have clutch assemblies.

* * * * *